United States Patent [19]

Koike

[11] Patent Number: 5,009,531

[45] Date of Patent: Apr. 23, 1991

[54] COLOR INK RIBBON AND PRINTER USING THIS RIBBON

[75] Inventor: Seiji Koike, Shizuoka, Japan

[73] Assignee: Tokyo Electric Co., Ltd., Tokyo, Japan

[21] Appl. No.: 464,949

[22] Filed: Jan. 16, 1990

[30] Foreign Application Priority Data

Jan. 20, 1989 [JP] Japan ..... 1-11634

[51] Int. Cl.[5] ..... B41J 31/09

[52] U.S. Cl. ..... 400/240.3

[58] Field of Search ..... 400/241, 240.3, 237, 400/208, 240.4, 240.1, 240

[56] References Cited

U.S. PATENT DOCUMENTS

| | | | |
|---|---|---|---|
| 4,401,390 | 8/1983 | Melissa et al. | 400/240.3 |
| 4,551,729 | 11/1985 | Kubo et al. | 400/240.3 |
| 4,558,329 | 12/1985 | Honda | 400/241 |
| 4,616,236 | 10/1986 | Watanabe et al. . | |
| 4,673,304 | 6/1987 | Liu et al. | 400/240.3 |
| 4,893,951 | 1/1990 | Iwatani et al. | 400/240.3 |

FOREIGN PATENT DOCUMENTS

| | | | |
|---|---|---|---|
| 0073888 | 4/1985 | Japan | 400/240.3 |
| 60-85975 | 4/1985 | Japan | 400/237 |
| 0257281 | 12/1985 | Japan | 400/240.3 |
| 0051474 | 3/1987 | Japan | 400/240.3 |
| 0142676 | 6/1987 | Japan | 400/240.3 |
| 0234967 | 10/1987 | Japan | 400/237 |
| 0119275 | 3/1984 | European Pat. Off. . | |

*Primary Examiner*—Eugene H. Eickholt

*Attorney, Agent, or Firm*—Frishauf, Holtz, Goodman & Woodward

[57] ABSTRACT

A color ink ribbon comprising a ribbon body on which a plurality of colors are sequentially aligned in a ribbon feeding direction, color recognition marks which sequentially represent next colors on the ribbon body by bar code information, and ribbon speed detection marks formed on the ribbon body at equal intervals in the ribbon feeding direction. The bar code marks and the speed detections marks are used together with a compensation coefficient to determine the identity of the subsequent color portion on the ink ribbon body.

16 Claims, 12 Drawing Sheets

COLOR INK RIBBON AND PRINTER USING THIS RIBBON

BACKGROUND OF THE INVENTION

1. Field of the Invention

The present invention relates to an improvement of a color ink ribbon and a printer using this ribbon.

2. Description of the Related Art

In a color ink ribbon used for, e.g., a color bar code printer, three primary colors, i.e., yellow (Y), magenta (M), and cyan (C) are sequentially aligned in the ribbon feeding direction. In addition, color recognition marks (bar codes) representing the types of primary color are formed immediately before portions of the three primary colors. A detector is arranged in a printer using this color ink ribbon to detect a color recognition mark of each of the three primary colors. The next color of the ink ribbon fed by a ribbon drive motor is detected in accordance with a detection output (i.e., a color recognition mark read output) from this detector. More specifically, black level detection outputs from the color recognition mark detector are counted to recognize a bar code width of each color recognition mark in accordance with the count. If the recognized bar code width is only width a, the color is discriminated as yellow (Y). If the width is a combination of width a and width *2a*, the color is discriminated as magenta (M). If the width is only width *2a*, the color is discriminated as cyan (C). Cuing of the ink ribbon corresponding to printing data is performed, and then a color image is printed on paper by a thermal head or the like.

Most of the color ink ribbon is wound around a ribbon supply core in an initial condition, and the color ink ribbon is sequentially supplied upon constant-speed rotation of the ribbon drive motor and is taken up by a ribbon take-up core. In an end condition, the most of the ribbon has already been taken up by the ribbon take-up core. Therefore, the ink ribbon feeding speed in the initial condition is different from that in the end condition. In particular, when the overall length of the ribbon is large or a core diameter is small, a speed difference is large.

Since a color to be fed next is determined by recognizing the width of a bar code formed on the ink ribbon, as described above, a large speed difference tends to cause color discrimination errors because the width of each bar code is erroneously detected. For this reason, an ink ribbon having a small overall length or a large core is conventionally used to overcome the above problem.

As described above, in the conventional color ink ribbon, since each bar code represents only the next color, color discrimination is erroneously performed by a change in ribbon feeding speed. For this reason, only a wasteful color ink ribbon having a small overall length or a large core is used in a color printer to always perform accurate color discrimination.

SUMMARY OF THE INVENTION

The present invention has been made in consideration of the above situation, and has as its object to provide a color ink ribbon capable of giving color information and ribbon feeding speed information. A bar code detection error caused by a change in ribbon feeding speed can be corrected on the basis of the ribbon feeding speed information, and the color to be fed next can always be discriminated.

It is another object of the present invention to provide a printer capable of accurately discriminating the color to be fed next by using the above color ink ribbon, of eliminating an influence of a color discrimination result caused by a change in ink ribbon feeding speed, and of using an economical color ink ribbon having a small ink ribbon take-up core diameter and a large overall length.

A color ink ribbon of the present invention has color recognition marks representing types of color and formed on a ribbon body on which a plurality of colors are sequentially aligned in a ribbon feeding direction, and ribbon speed detection marks are formed at equal intervals along the ribbon feeding direction.

A printer according to the present invention comprises a first mark detector for detecting a color recognition mark formed on a color ink ribbon, a second mark detector for detecting a ribbon speed detection mark formed on the same color ink ribbon, speed recognizing means for detecting a feeding speed of the same color ink ribbon on the basis of a detection output from said second mark detector, and color discriminating means for discriminating the next color on the basis of the ribbon feeding speed recognized by the speed recognizing means and a detection output from the first mark detector.

In the color ink ribbon of the present invention, since the ribbon speed detection marks are formed at predetermined intervals (e.g., equal intervals) in the ribbon feeding direction, the interval between the ribbon speed detection marks is detected during ribbon feeding, and therefore a ribbon feeding speed can be recognized. A read color recognition mark is corrected by the ribbon feeding speed, and the next color is discriminated, thereby performing accurate color discrimination.

In the printer of the present invention, when the color ink ribbon is fed through a drive mechanism, the color recognition mark formed on the ink ribbon is detected by the first mark detector. The ribbon speed detection marks formed on this ink ribbon at the predetermined intervals are detected by the second mark detector. The ribbon feeding speed is recognized by the intervals between the ribbon speed detection marks in accordance with the detection outputs from the second mark detector. The color recognition mark (bar code) represented by the detection output from the first mark detector is corrected on the basis of the recognized ribbon feeding speed, thereby discriminating the next color. In the printer having the above arrangement, cuing of this ink ribbon is performed on the basis of printing data, and desired color data is printed on paper through the printing head.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

Figure 1:
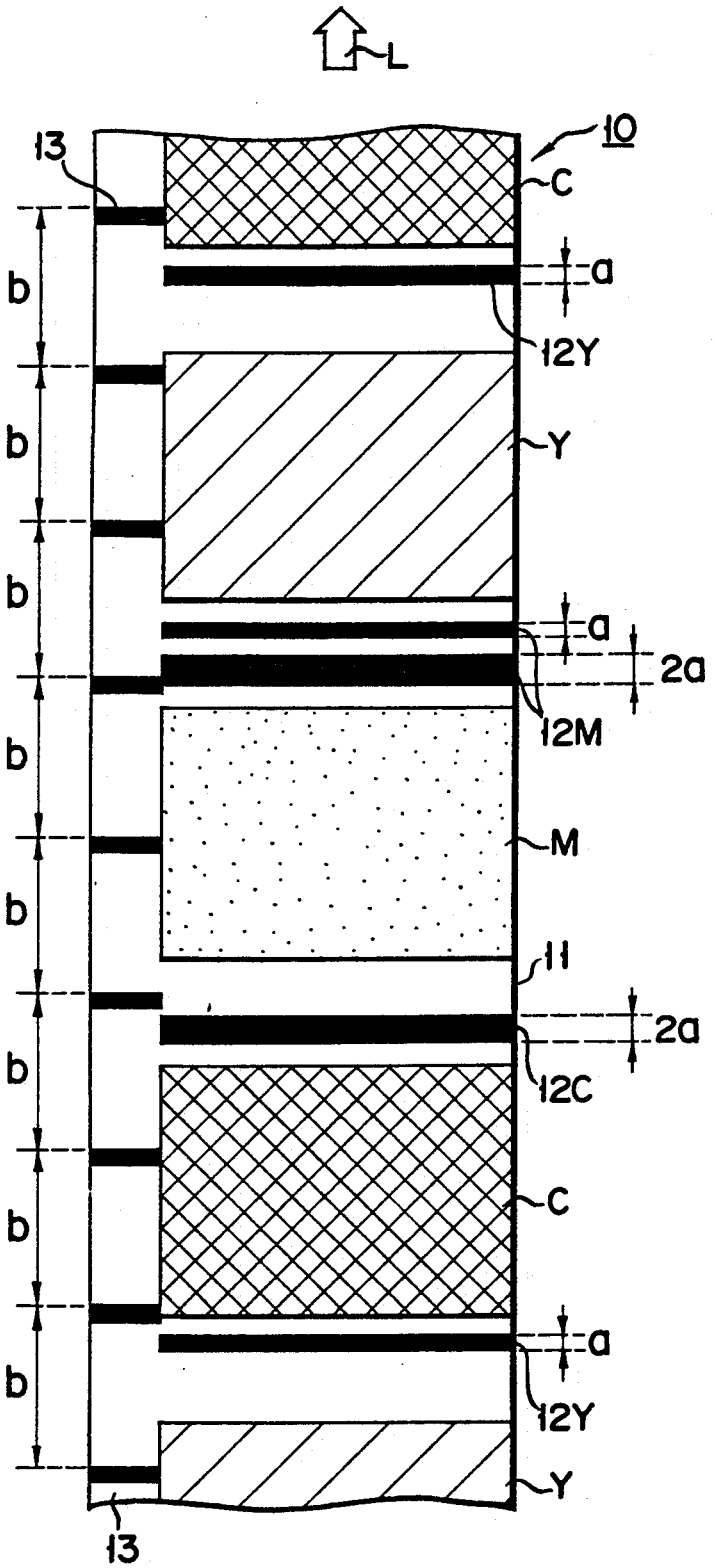
FIG. 1 illustrates a color ink ribbon according to an embodiment of the present invention.

Preferred embodiments of the invention will be described with reference to the accompanying drawings. In the description the same or similar elements are denoted by the same or similar reference numerals, in order to simplify the description.

FIG. 1 is a view showing color ink ribbon 10 according to an embodiment of the present invention, three primary colors, i.e., yellow (Y), magenta (M), and cyan (C) are sequentially aligned on ribbon body 11 in a ribbon feeding direction (i.e., a direction of thick arrow L in FIG. 1), and color recognition marks 12 representing the types of primary color in the form of bar code information are formed immediately before the respective primary colors. In this embodiment, yellow (Y) is represented by color recognition mark 12Y consisting of bar code information of width a. Magenta (M) is represented by color recognition mark 12M consisting of bar code information of width a and width 2*a*. Cyan (C) is represented by color recognition mark 12*c* consisting of bar code information of width 2*a*. Ribbon speed detection marks 13 consisting of black bars at equal intervals b are formed in ribbon feeding direction L of ribbon body 11.

Figure 2:
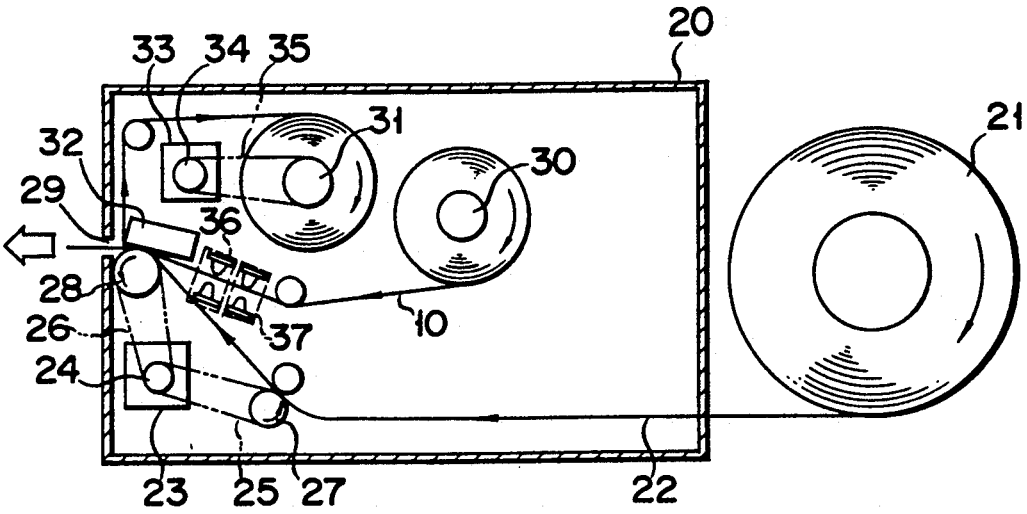
FIGS. 2 and 3 show schematic configurations of a printer using the color ink ribbon of the invention.
Figure 3:
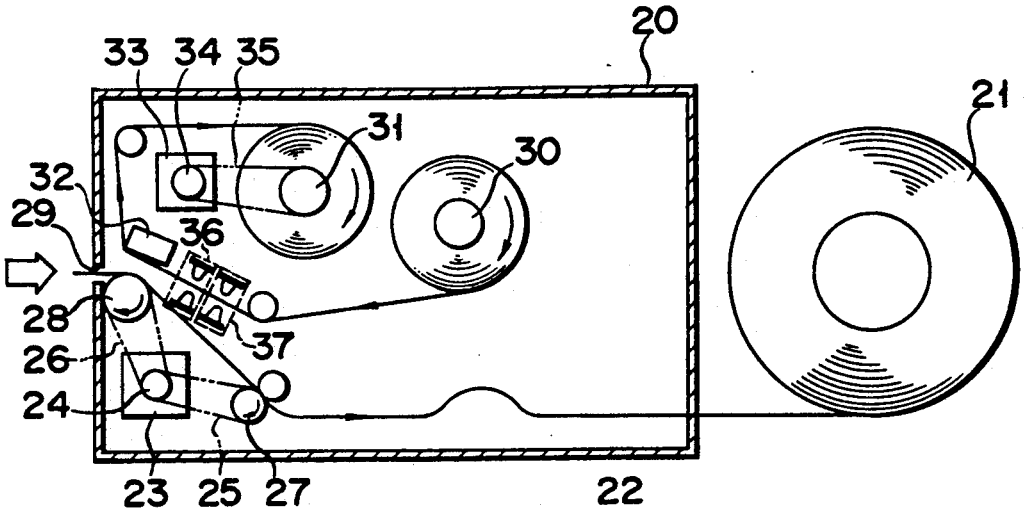

FIGS. 2 and 3 are sectional views illustrating an arrangement of a color bar code printer 20 using the above color ink ribbon 10. FIG. 2 shows a printing state, and FIG. 3 shows a paper feedback state and a cuing state of color ink ribbon 10. In the figure, a paper roll is denoted by numeral 21. Paper 22 wound around a paper holder is conveyed by pinch roller 27 and platen 28 rotated counterclockwise through belts 25 and 26 looped around pulley 24 upon forward rotation of feeding motor 23. Paper 22 is then exhausted outside printer 20 through paper exhaust port 29.

In a feedback mode (FIG. 3), paper 22 is conveyed by pinch roller 27 and platen 28 rotated clockwise upon reverse rotation of feeding motor 23 and is then drawn inside printer 20 from paper exhaust port 29.

In a printing mode (FIG. 2), color ink ribbon 10 wound around supply core 30 is fed by platen 28 rotated counterclockwise upon forward rotation of feeding motor 23. Color ink ribbon 10 is taken up by take-up core 31 rotated clockwise through belt 35 arranged on pulley 34 upon forward rotation of ribbon motor 33. In this case, thermal head 32 serving as a printing head abuts against platen 28 through color ink ribbon 10 and paper 22. Desired bar code data is printed in color on paper 22.

In a cuing mode (FIG. 3) of color ink ribbon 10, thermal head 32 is separated from platen 28, and ribbon 10 is taken up by ribbon take-up core 31 rotated clockwise upon forward rotation of ribbon motor 33.

Reference numerals 36 and 37 respectively denote first and second mark detectors each consisting of a pair of light-emitting and light-receiving sensors arranged to oppose each other through color ink ribbon 10. First mark detector 36 detects color recognition mark 12 on color ink ribbon 10, and second mark detector 37 detects ribbon speed detection mark 13 on color ink ribbon 10.

Figure 4:
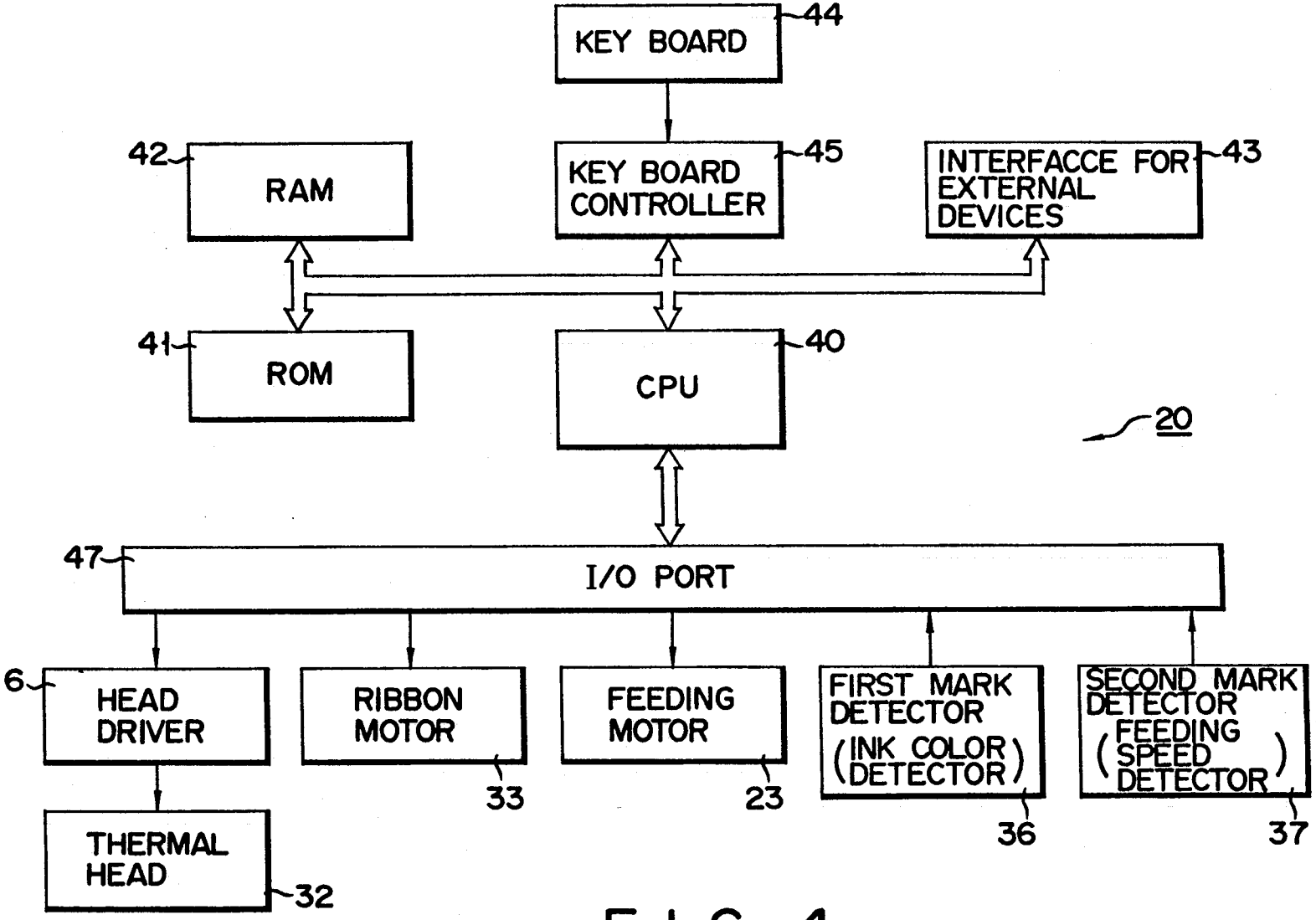
FIG. 4 is a block diagram showing an electronics part of the printer.

FIG. 4 is a block diagram showing a control circuit of color bar code printer 20. Reference numeral 40 denotes a CPU (or microcomputer) serving as a controller. CPU 40 is connected to ROM (Read-Only Memory) 41 for storing permanent data such as programs and a character generator, RAM (Random Access Memory) 42 for storing variable data required for controlling the respective components in FIG. 4, interface 43 for external devices for receiving printing data from external devices (not shown), and keyboard controller 45 for keyboard 44 on which various keys such as a start key and a stop key are arranged. The circuit of FIG. 4 also includes head driver 46 for thermal head 32, and I/O (Input/Output) port 47 for outputting a drive signal from CPU 40 to ribbon motor 33 and feeding motor 23 and supplying detection signals from first and second mark detectors 36 and 37 to CPU 40.

Figure 5:
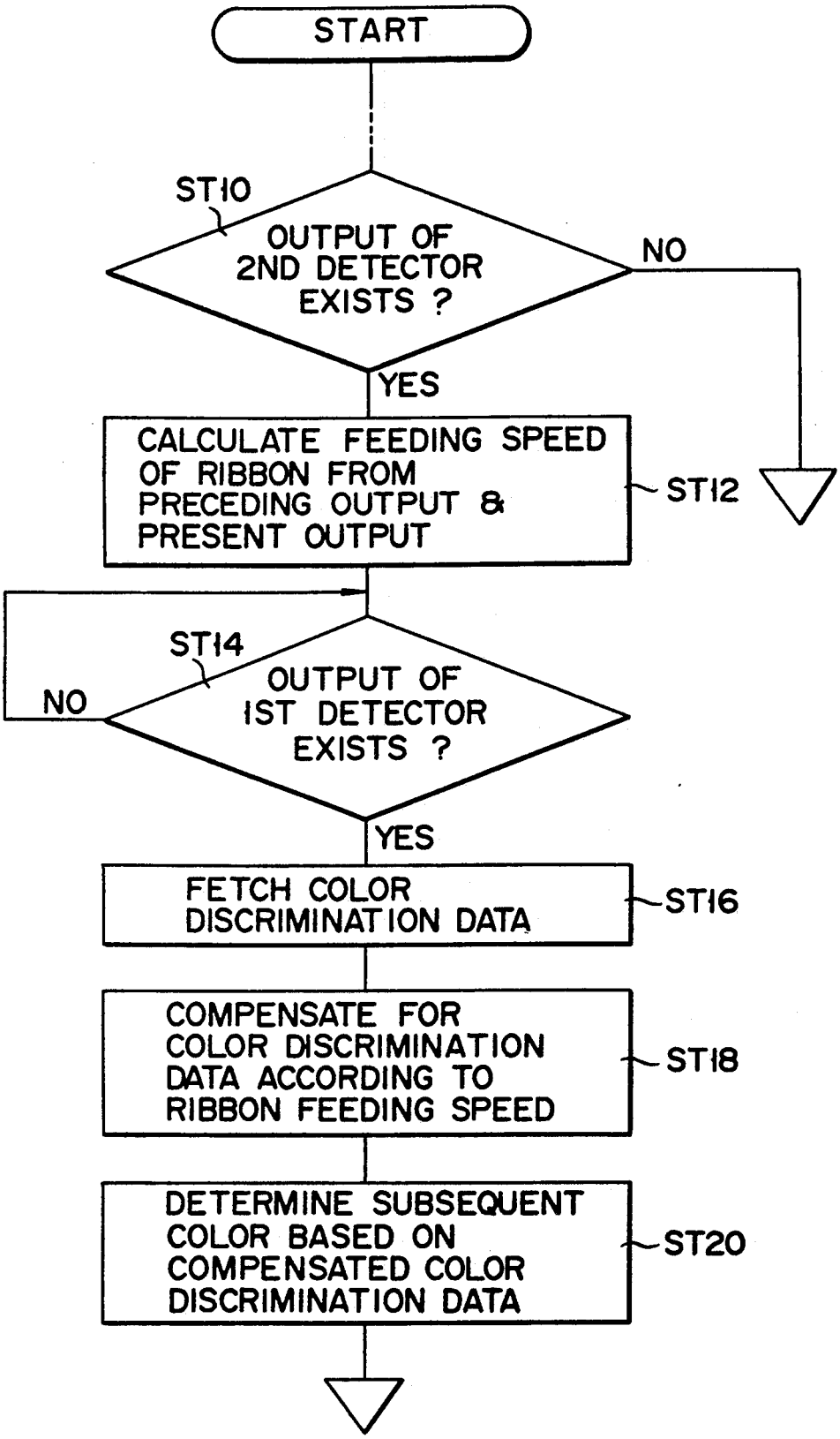
FIG. 5 is a flow chart explaining an operation of the CPU shown in FIG. 4.

The processing shown in a flow chart of FIG. 5 is executed by CPU 40. More specifically, when CPU 40 detects that a black bar detection output from second mark detector 37 during the operation (YES in ST10), relative interval b between adjacent two ribbon speed detection marks 13 is obtained from time difference t between the previous detection output and the present detection output (ST12). Feeding speed v of color ink ribbon 10 is calculated by the following equation on the basis of relative interval b:

$$v = b/t \quad (1)$$

When a detection output from first mark detector 36 is present (YES in ST14), color recognition data identified by widths a and 2*a* of color recognition mark (bar code) 12 is fetched (ST16). This color recognition data is corrected by the following equation on the basis of the calculated ribbon feeding speed v (ST18).

Period ta for detecting detection mark width a is given as:

$$ta = a/v \quad (2)$$

Correction coefficient C for detecting width a is given as:

$$C = ta/t = (a/b;\ \text{constant}) \quad (3)$$

Period t2a for detecting detection mark width 2*a* is given as follows:

$$t2a = 2a/v = 2ta \quad (4)$$

Correction coefficient D for detecting width 2*a* given as follows:

$$D = t2a/t = 2ta/t = 2C\ (\text{constant}) \quad (5)$$

The types of primary color arranged on the ink ribbon body are discriminated on the basis of corrected color recognition data (a or 2*a*) multiplied with coefficient C or D (ST20). That is, if the bar code width of the color recognition data is only width a, then color recognition data is discriminated to represent yellow (Y); if a and 2*a*, then magenta (M); if only 2*a*, then cyan (C). Ribbon cuing is controlled in accordance with desired printing data on the basis of this color discrimination result.

In this embodiment having the above arrangement, in the printing mode, paper 22 and color ink ribbon 10 are fed upon rotation of platen 28, and the feeding speed of paper 22 is equal to that of color ink ribbon 10. In the paper feedback mode or the cuing mode, paper 22 is fed at a constant speed upon rotation of platen 28. However, since color ink ribbon 10 is taken up by ribbon take-up core 31 upon its rotation, the feeding speed of color ink ribbon 10 varies depending on the diameter of the ribbon take-up portion.

Figure 6:
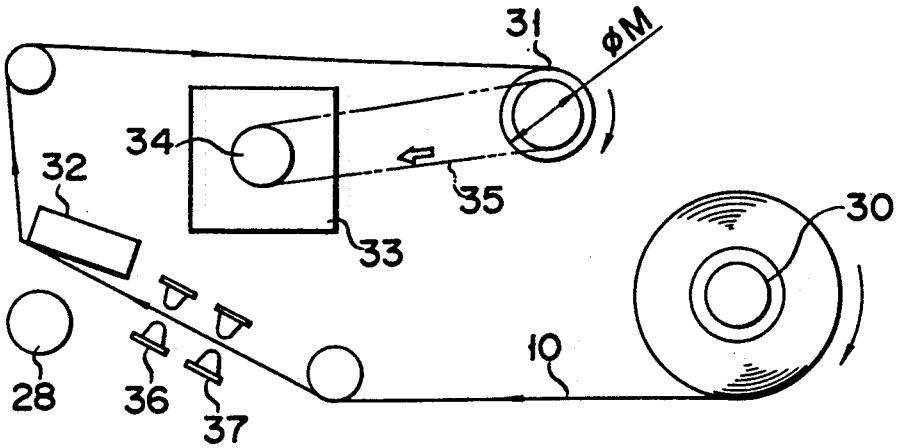
FIG. 6 illustrates an initial condition of the ink ribbon in the printer.

In this embodiment, color ink ribbon 10 is almost wound around ribbon supply core 30 in the initial condition of color ink ribbon 10, as shown in FIG. 6. The diameter of ribbon take-up core 31 including a ribbon portion is M as the diameter of the ribbon take-up core 31. In the initial condition, since the ribbon feeding speed is low, a detection signal for color recognition mark 12M of magenta (M) from first mark detector 36 is generated such that bar code information of width a is read during a time interval between time t1 and time t3, and bar code information of width 2*a* is read during a time interval between time t5 and time t9.

Figure 8:
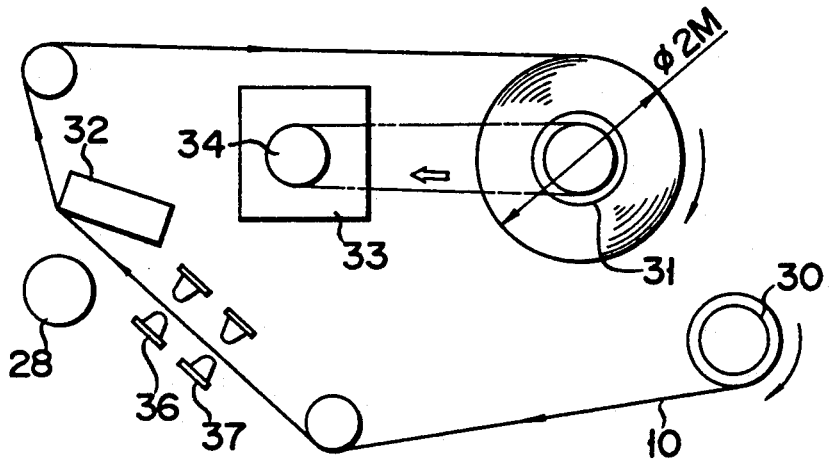
FIG. 8 illustrates an end condition of the ink ribbon in the printer.

To the contrary, in the end condition of color ink ribbon 10, as shown in FIG. 8, most of color ink ribbon 10 is taken up by ribbon take-up core 31, and the diameter of ribbon take-up core 31 including a ribbon portion becomes, e.g., 2M. In the end condition, the ribbon feeding speed becomes twice that in the initial condition. A detection signal for color recognition mark 12M of, e.g., magenta (M) from first mark detector 36 is generated such that bar code information of width is read during a time interval between time t1 and time t2, and bar code information of width 2*a* is read during a time interval between time t3 and time t5.

In this embodiment, ribbon speed detection marks 13 formed on color ink ribbon at equal intervals in the ribbon feeding direction are detected by second mark detector 37, and the feeding speed (v) of ink ribbon 10 is calculated in accordance with a relative change in mark intervals. The detection signal (a or 2*a*) from first mark detector 36 is corrected (xC or xD), and color recognition mark 12 on ink ribbon 10 is decoded by the corrected data. The next color is then determined to control cuing.

Figure 7:
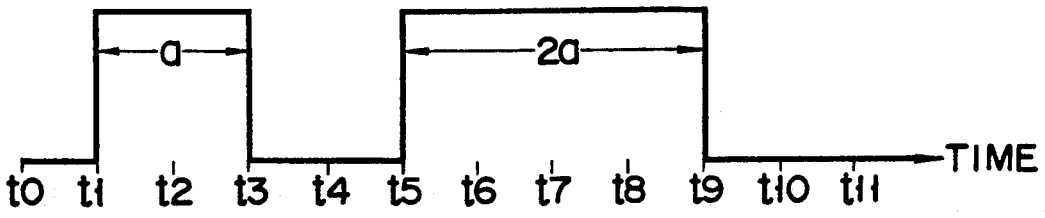
FIG. 7 is a waveform of an output from the first mark detector shown in FIG. 4 wherein the ink ribbon is in the initial condition of FIG. 6.
Figure 9:
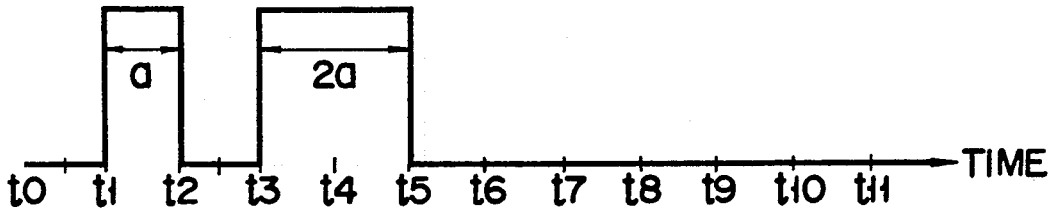
FIG. 9 is another waveform of an output from the first mark detector shown in FIG. 4 wherein the ink ribbon is in the end condition of FIG. 8.

In this case, the ribbon feeding speed in the initial condition of color ink ribbon 10 is given as reference speed (v0), and a detection output from first mark detector 36 may be corrected in proportion $(v0+\Delta v)/v0)$ to a change in speed with respect to the reference speed (v0). For example, since the ribbon feeding speed in the end condition is twice the reference speed, output data (FIG. 9) from first mark detector 36 is doubled. The corrected output coincides with the detection output shown in FIG. 7, and the next primary color can be discriminated as magenta (M).

In this embodiment, since ribbon speed detection marks 13 are formed on color ink ribbon 10 in the ribbon feeding direction, a change in speed or a speed change correction coefficient (C or D) of color ink ribbon 10 can be calculated by a detection interval of marks 13. The detection output of color recognition mark 12 is corrected on the basis of the change in speed of the ribbon or its correction coefficient, and the next primary color can be discriminated, thereby always performing accurate color discrimination.

As a result, speed control can cope with a great change in speed between the initial condition and the end condition. Therefore, color ink ribbon 10 having a small core diameter and a large overall length can be used in printer 20, thereby reducing expenses.

In addition, since accurate color discrimination can be performed even if a ribbon having a small core diameter which causes a change in ribbon feeding speed is used, a large-capacity color bar code printer ribbon can be formed in practice.

In the above embodiment, the feeding speed in the ribbon initial condition is given as the reference speed (v0), but is not limited to this. Since it is necessary to detect only a relative change in speed, correction can be performed using the feeding speed of the end condition as the reference speed.

Figure 10:
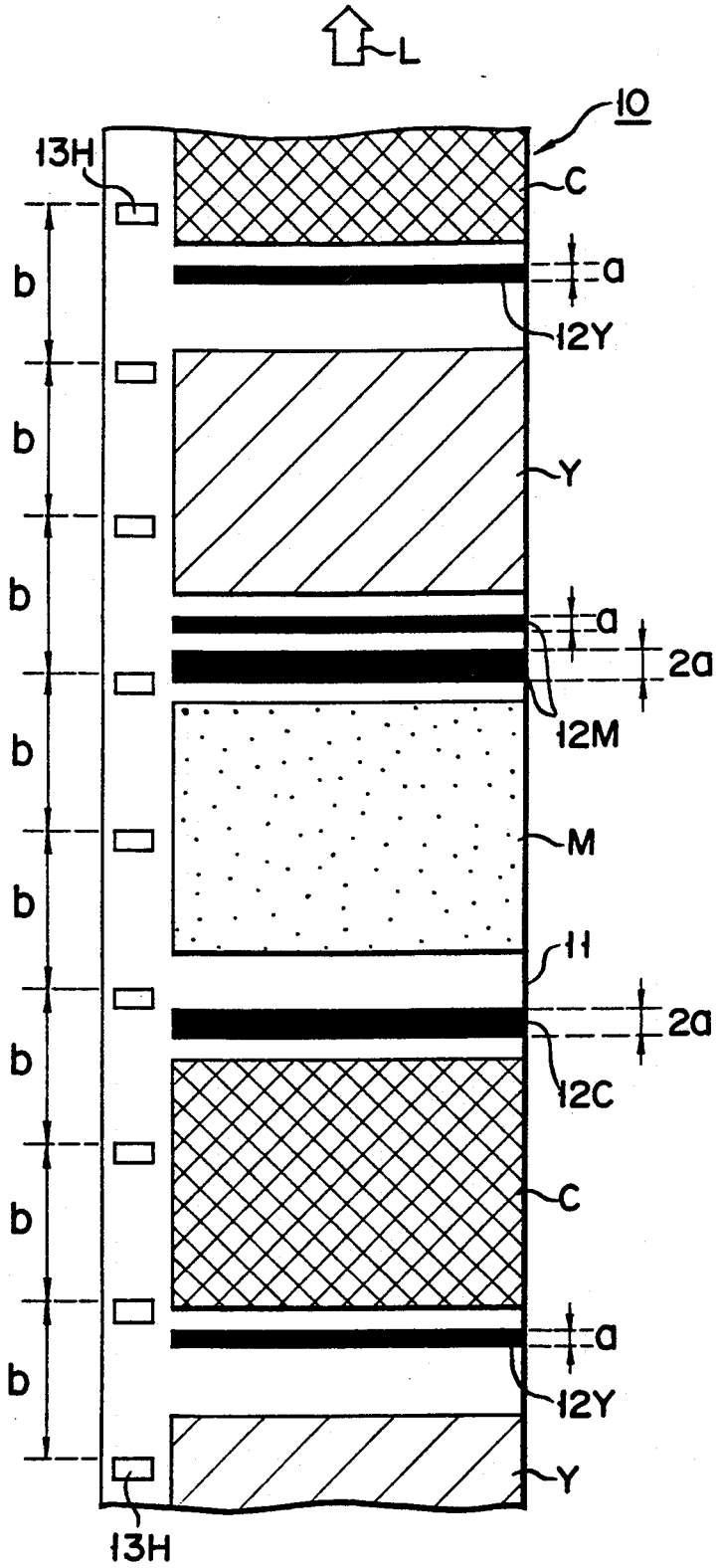
FIG. 10 illustrates a color ink ribbon according to another embodiment of the present invention, wherein the speed detection marks are formed by holes 13H.
Figure 11:
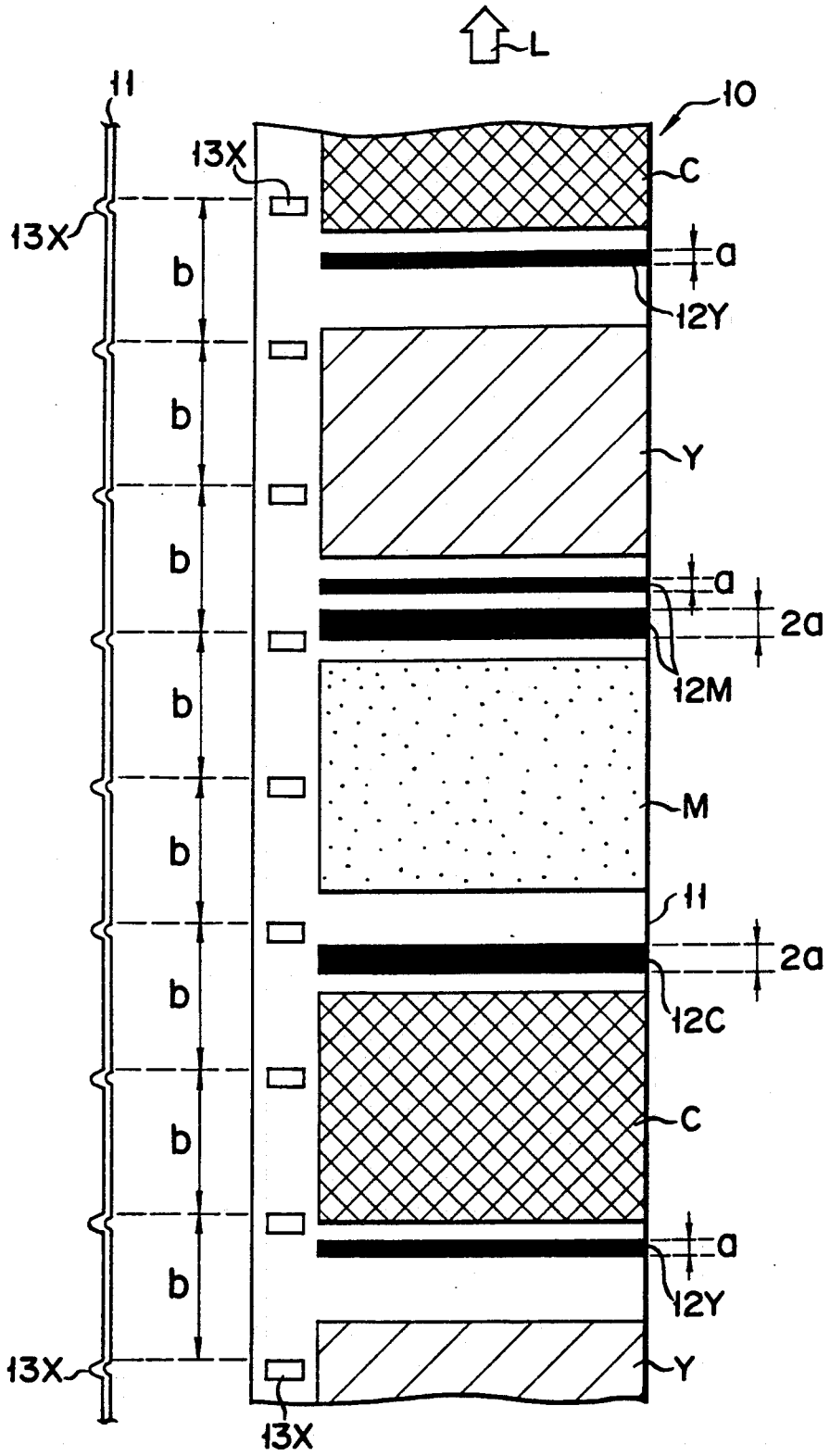
FIG. 11 illustrates a color ink ribbon according to another embodiment of the present invention, wherein the speed detection marks are formed by projections 13X.

In addition, black bars are exemplified as ribbon speed detection marks 13 in the embodiment of FIG. 1. However, holes 13H may be formed along one side of ribbon 10, as shown in FIG. 10, or projections 13X may be formed along one side of ribbon 10, as shown in FIG. 11.

Figure 12:
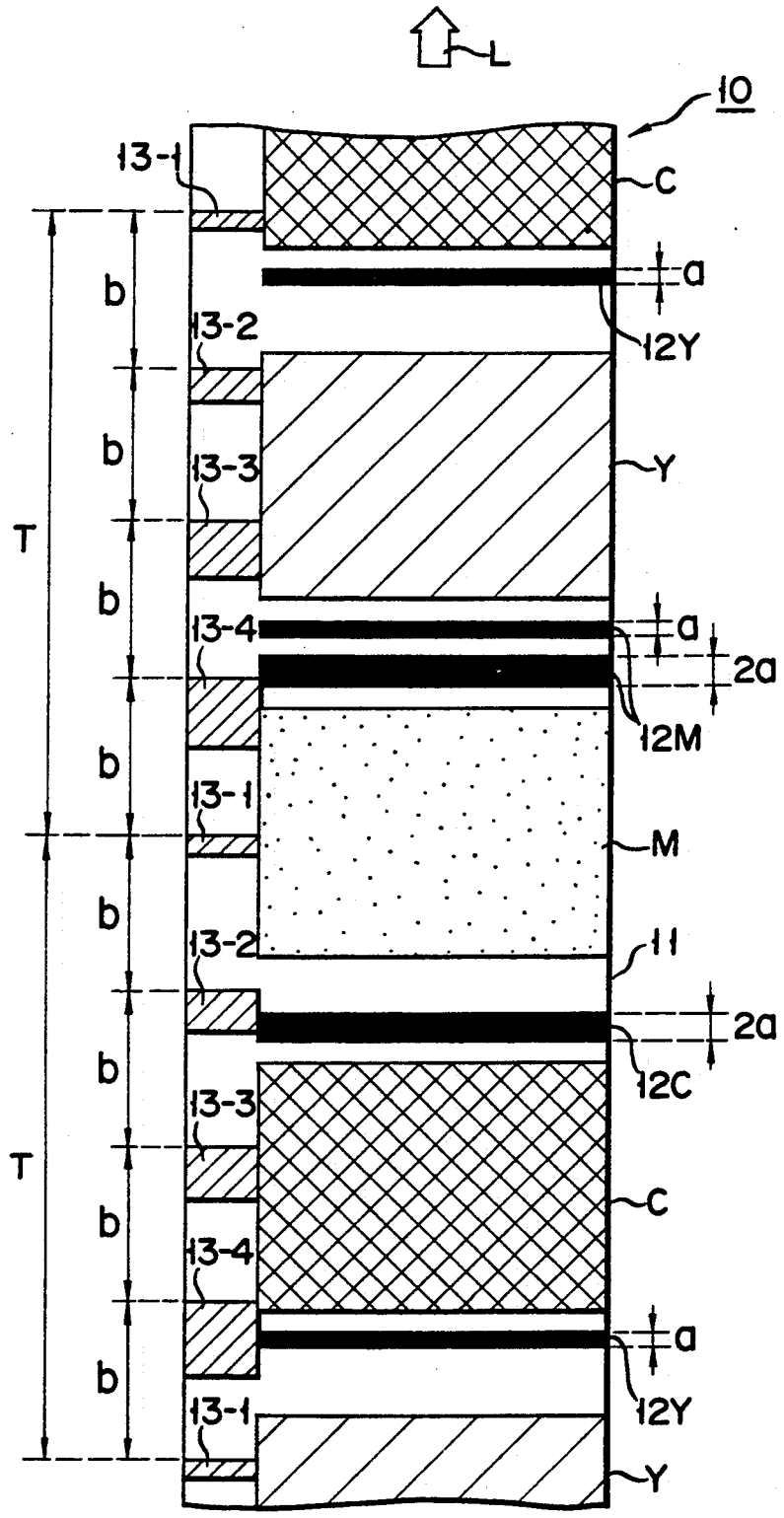
FIG. 12 illustrates a color ink ribbon according to another embodiment of the present invention, wherein the speed detection marks are formed by a periodically arranged (period T) marks 13-1 to 13-4 having various widths.

As shown in FIG. 12, four types of width marks 13-1 to 13-4 arranged at equal intervals (b) repeated by predetermined period T may be used for speed detection.

Figure 13:
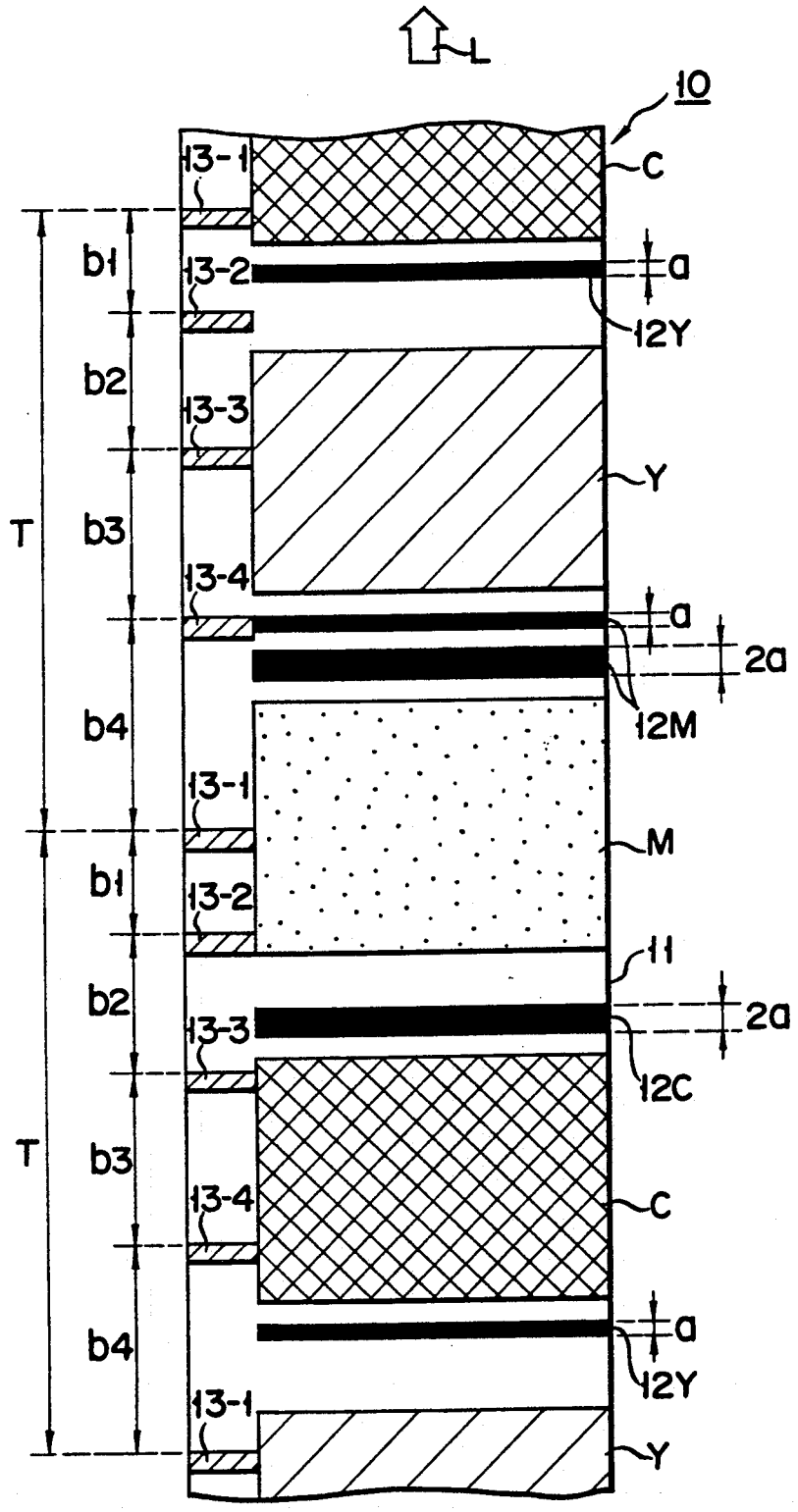
FIG. 13 illustrates a color ink ribbon according to another embodiment of the present invention, wherein the speed detection marks are formed by a periodically arranged (period T) marks 13-1 to 13-4 having various intervals (b1–b4)

Alternatively, as shown in FIG. 13, four types of intervals (b1 to b4) repeated at predetermined period T may be used for speed detection.

Figure 14:
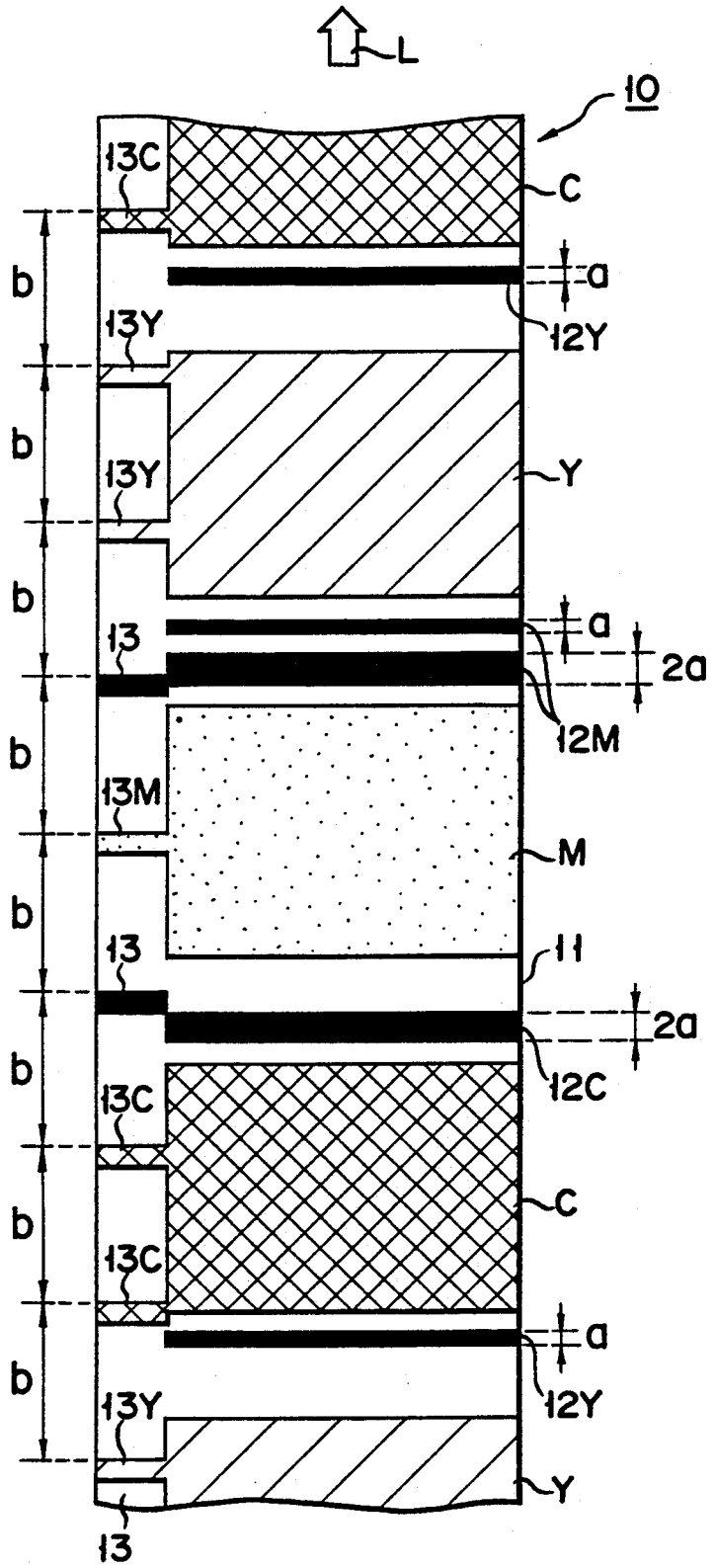
FIG. 14 illustrates a color ink ribbon according to another embodiment of the present invention, wherein the speed detection marks are formed by part (13Y, 13M, 13C) of the ink ribbon colors (Yellow, Magenta, Cyan)

Furthermore, as shown in FIG. 14, parts (13Y, 13M, and 13C) of speed detection marks 13 may be formed by Y, M, and C inks.

The embodiment shown in FIG. 1 exemplifies color ink ribbon 10 having three primary colors. However, the present invention is applicable to a color ink ribbon having at least two arbitrary colors (e.g., red and black). Various changes and modifications may be made without departing the spirit and scope of the invention.

Figure 15:
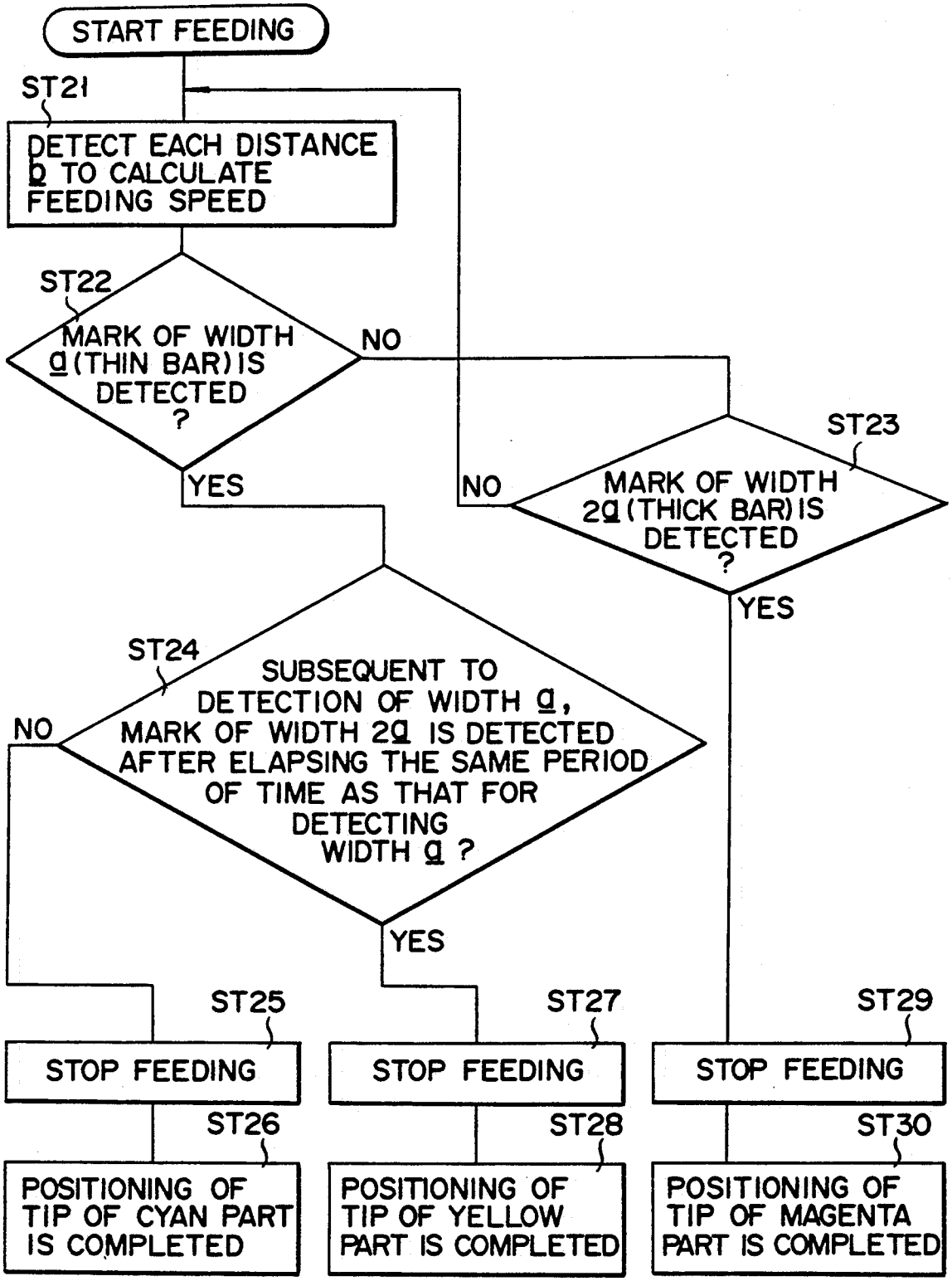
FIG. 15 is a flow chart explaining how the color of an ink ribbon is determined.

FIG. 15 is a flow chart explaining how the color of an ink ribbon is determined.

When the feeding of ink ribbon 10 starts, the feeding speed is calculated from each interval b of the speed detection marks (ST21). This calculation corresponds to step ST12 in FIG. 5. The width a or 2a of color discrimination mark 12 is compensated for in accordance with the calculated feeding speed. This compensation corresponds to step ST18 in FIG. 5.

If neither color discrimination mark 12 of width a (thin bar code) nor that of width 2a (thick bar code) is detected (ST22 NO; ST23 YES), the process returns to step ST21.

When color discrimination mark 12 of width a is detected (ST22 YES), after elapsing a time period required to detect the discrimination mark of with a, it is checked whether or not color discrimination mark 12 of width 2a is detected (ST24). If, at this time, mark 12 of width 2a is not detected, (ST24 NO), the feeding operation of ink ribbon 10 is stopped (ST25), and the positioning of the tip of the cyan part is completed (ST26)

When color discrimination mark 12 of width 2a is detected after elapsing the time period required to detect the discrimination mark of with a (ST24 YES), the feeding operation of ink ribbon 10 is stopped (ST27), and the positioning of the tip of the yellow part is completed (ST28).

When color discrimination mark 12 of width a is not detected (ST22 NO) but color discrimination mark 12 of width 2a is detected (ST23 YES), the feeding operation of ink ribbon 10 is stopped (ST29), and the positioning of the tip of the magenta part is completed (ST30).

The above process for positioning the tip of each of cyan, yellow, and magenta corresponds to step ST20 in FIG. 5.

As has been described above, the present invention has the following features.

(i) There is provided a color ink ribbon wherein the next color can be represented by bar code information, and at the same time the ribbon feeding speed information can also be provided. A bar code width detection error caused by a change in speed can be compensated on the basis of the speed information, and the color to be fed next can be accurately discriminated.

(ii) There is also provided a printer wherein the next color can be accurately discriminated by using the color ink ribbon described above, and the influence of the color discrimination result by a change in feeding speed of the ink ribbon can be eliminated, and an economical color ink ribbon having a small core diameter and a large overall length can be used.

While the invention has been described in connection with what is presently considered to be the most practical and preferred embodiment, it is to be understood that the invention is not limited to the disclosed embodiment but, on the contrary, is intended to cover various modifications and equivalent arrangements included within the scope of the appended claims, which scope is to be accorded the broadest interpretation so as to encompass all such modifications and equivalent arrangements.

What is claimed is:

1. A printer system comprising:

an ink ribbon body on which a plurality of kinds of ink portions are arranged, said ink portions being arranged along a feed direction of said ink ribbon body;

means for discriminating the kinds of said ink portions and for providing ink kind information, said discriminating means being arranged on said ink ribbon body in correspondence with each of said ink portions;

means for detecting a feeding speed of said ink ribbon body and for providing ribbon speed information, said detecting means being arranged on said ink ribbon body; and means for determining the kind of ink portion which is subsequent to a current ink portion to be used by the printer system, according to said ink kind information and said ribbon speed information.

2. The system of claim 1, wherein said detecting means includes a plurality of speed detection marks arranged at given intervals along the feed direction of said ink ribbon body.

3. The system of claim 1, wherein said detecting means includes a plurality of speed detection marks arranged with a constant interval therebetween along the feed direction of said ink ribbon body, said speed detection marks being located beside said ink portions.

4. The system of claim 1, wherein said detecting means includes a plurality of speed detection mark groups periodically arranged at given periodic intervals along the feed direction of said ink ribbon body, said speed detection mark groups being located beside said ink portions.

5. The system of claim 1, wherein said detecting means includes speed detection patterns arranged at given intervals along the feed direction of said ink ribbon body, said speed detection patterns being located independent of said ink portions.

6. The system of claim 1, wherein said detecting means includes speed detection holes arranged at given intervals along the feed direction of said ink ribbon body, said speed detection holes being located independent of said ink portions.

7. The system of claim 1, wherein said detecting means includes speed detection projections arranged at given intervals along the feed direction of said ink ribbon body, said speed detection projections being located independent of said ink portions.

8. The system of claim 1, wherein said detecting means includes speed detection marks arranged at given intervals along the feed direction of said ink ribbon body, said speed detection marks being formed by part of said ink portions.

9. The system of claim 1, wherein said discriminating means includes bar code marks respectively arranged between each adjacent two of said ink portions.

10. The system of claim 1, wherein one of said ink portions includes one unicolor ink, and another one of said ink portions includes another unicolor ink.

11. The system of claim 1, wherein one of said ink portions includes one unicolor ink, another one of said ink portions includes another unicolor ink, and still another one of said ink portions includes still another unicolor ink.

12. The system of claim 1, wherein one of said ink portions includes a portion of cyan ink, a portion of magenta ink, and a portion of yellow ink.

13. A printer using a color ink ribbon which comprises.

an ink ribbon body on which a plurality of color ink portions are arranged along a feeding direction of said ink ribbon body;

color discrimination marks each for discriminating the color of each of said color ink portions, said color discrimination marks being arranged on said ink ribbon body in correspondence with each of said color ink portions; and speed detection marks for detecting a feeding speed of said ink ribbon body, said speed detection marks being arranged on said ink ribbon body;

said printer comprising:

means for time-sequentially detecting each of said speed detection marks to calculate the feed speed of said ink ribbon body which is fed at a nonconstant speed;

means for detecting said color discrimination marks; and means, responsive to a compensation coefficient, for compensating for the detected color discrimination marks to determine the kind of color of each of said color ink portions in accordance with a content of the compensated color discrimination marks.

14. A printer comprising a color ink ribbon formed of a ribbon body on which a plurality of colors are sequentially aligned in a ribbon feed direction, color recognition marks which sequentially represent subsequent colors on said ribbon body by code information, and ribbon speed detection marks formed on said ribbon body at predetermined intervals in the ribbon feed direction, said printer comprising:

means for feeding the color ink ribbon to perform color printing using given data through a printing head;

first mark detector means for detecting the color recognition mark formed on said color ink ribbon to provide a color detection output;

second mark detector means for detecting the ribbon speed detection mark formed on said color ink ribbon to provide a speed detection output;

means for recognizing the feed speed of said color ink ribbon on the basis of the speed detection output to provide a recognized speed output; and means of discriminating the subsequent color on the basis of the recognized speed output and the color detection output.

15. The printer of claim 14, wherein said predetermined intervals are equal intervals.

16. The printer of claim 14, wherein said code information includes a bar code.

* * * * *